US009404170B2

(12) United States Patent
Ju et al.

(10) Patent No.: US 9,404,170 B2
(45) Date of Patent: Aug. 2, 2016

(54) METHOD FOR INCREASING MECHANICAL STRENGTH OF TITANIUM ALLOYS HAVING α" PHASE BY COLD WORKING

(71) Applicant: NATIONAL CHENG KUNG UNIVERSITY, Tainan (TW)

(72) Inventors: Chien-Ping Ju, Kansas, MO (US); Jiin-Huey Chern Lin, Winnetka, IL (US)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 293 days.

(21) Appl. No.: 13/706,386

(22) Filed: Dec. 6, 2012

(65) Prior Publication Data

US 2013/0139564 A1 Jun. 6, 2013

Related U.S. Application Data

(60) Provisional application No. 61/567,189, filed on Dec. 6, 2011.

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
USPC ..... 72/75, 377, 378, 199–252.5, 352–360, 72/274–292
See application file for complete search history.

(56) References Cited

U.S. PATENT DOCUMENTS

| | | | | |
|---|---|---|---|---|
| 4,799,975 | A | 1/1989 | Ouchi et al. | |
| 5,169,597 | A | 12/1992 | Davidson et al. | |
| 5,222,282 | A | 6/1993 | Sukonnik | |
| 5,226,989 | A | 7/1993 | Sukonnik | |
| 5,281,285 | A | 1/1994 | Marquardt | |
| 5,698,050 | A | 12/1997 | El-Soudani | |
| 5,906,692 | A | 5/1999 | Bhowal et al. | |
| 5,954,724 | A | 9/1999 | Davidson | |
| 6,399,215 | B1 * | 6/2002 | Zhu | B21C 23/001 148/407 |
| 6,409,852 | B1 * | 6/2002 | Lin | A61L 27/06 148/421 |

(Continued)

FOREIGN PATENT DOCUMENTS

EP 1 352 979 A1 10/2003

OTHER PUBLICATIONS

Tensile Behavior and Cold Workability of Ti-Mo Alloys; Takemoto et al.; Materials Transactions, vol. 45, No. 5 (2004) pp. 1571-1576.*
Takemoto et al. Tensile Behavior and Cold Workability of Ti-Mo Alloys, Materials transactions, vol. 45, No. 5, p. 1571-1576.*
International Search Report dated Mar. 21, 2013 issued in corresponding PCT application No. PCT/US2012/067945.
International Search Report dated Mar. 25, 2013 issued in corresponding PCT application No. PCT/US2012/067969.

(Continued)

*Primary Examiner* — Shelley Self
*Assistant Examiner* — Peter Iannuzzi
(74) *Attorney, Agent, or Firm* — Bacon & Thomas, PLLC

(57) ABSTRACT

A process for making an article of a titanium alloy having α" phase as a major phase according to the present invention includes providing a work piece of a titanium alloy consisting essentially of 7-9 wt % of molybdenum and the balance titanium and having α" phase as a major phase; and cold working at least a portion of the work piece at room temperature to obtain a green body of the article, wherein the cold worked portion of the green body has a thickness which is 20%-80% of that of the at least a portion of the work piece, and the cold worked portion has α" phase as a major phase.

12 Claims, 1 Drawing Sheet

(56) References Cited

U.S. PATENT DOCUMENTS

| | | | | |
|---|---|---|---|---|
| 6,726,787 | B2 | 4/2004 | Chern et al. | |
| 7,261,782 | B2 * | 8/2007 | Hwang | C22F 1/183 148/421 |
| 2003/0188810 | A1 * | 10/2003 | Tanaka | A61L 27/06 148/563 |
| 2004/0159374 | A1 | 8/2004 | Lin et al. | |
| 2005/0161130 | A1 | 7/2005 | Tanaka et al. | |
| 2006/0231178 | A1 * | 10/2006 | Lin | C22F 1/183 148/670 |
| 2010/0209666 | A1 * | 8/2010 | Rivard | A61F 2/30767 428/148 |

OTHER PUBLICATIONS

Josh Pelleg, "Mechanical Properties of Materials", Solid Mechanics and its Applications, Springer Science + Business Media Dordrecht, 2013, p. 151.

Broom et al., "Plastic Deformation, Fracture and Dislocation Structures in the Orthorhombic Intermetallic Phase Al3Ni", Acta Metallurgica, vol. 23, Apr. 1975, pp. 537-546.

Cementite, Wikipedia the free encyclopedia, https://en.wikipedia.org/wiki/Cementite.

Gerhard Sauthoff, "Intermetallics", Weinhiem; New York; Basel; Cambridge; Tokyo; 1995, p. 116.

* cited by examiner

METHOD FOR INCREASING MECHANICAL STRENGTH OF TITANIUM ALLOYS HAVING α" PHASE BY COLD WORKING

CROSS REFERENCE TO RELATED PATENT APPLICATIONS

The present patent application claims the benefit of U.S. provisional patent application No. 61/567,189, filed Dec. 6, 2011, the contents of which are hereby incorporated by reference in their entireties.

FIELD OF THE INVENTION

The present invention is related to a titanium-molybdenum alloy having α" phase as a major phase with an enhanced mechanical properties by cold working, and in particular to a medical implant of a titanium-molybdenum alloy having α" phase as a major phase with an enhanced mechanical properties by cold working.

BACKGROUND

Titanium and titanium alloys have been popularly used in many medical applications due to their light weight, excellent mechanical performance and corrosion resistance. Examples for use of commercially pure titanium (c.p. Ti) include a dental implant, crown and bridge, denture framework, pacemaker case, heart valve cage and reconstruction devices, etc. Nevertheless, due to its relatively low strength, c.p. Ti may not be used for high load-bearing applications.

The most widely-used titanium alloy for load-bearing applications is Ti-6Al-4V alloy (the work-horse titanium alloy). With a much higher strength than c.p. Ti, Ti-6Al-4V alloy has been widely used in a variety of stress-bearing orthopedic applications, such as hip prosthesis and artificial knee joint. Moreover, the lower elastic modulus allows the titanium alloy to more closely approximate the stiffness of bone for use in orthopedic devices compared to alternative stainless steel and cobalt-chrome alloys in orthopedic implants. Thus, devices formed from the titanium alloy produce less bone stress shielding and consequently interfere less with bone viability.

One major potential problem with Ti-6Al-4V alloy as being used as an implant material is its less biocompatible Al and V elements. Studies indicated that release of Al and/or V ions from Ti-6Al-4V implant might cause long-term health problems (Rao et al. 1996, Yumoto et al. 1992, Walker et al. 1989, McLachlan et al. 1983). Its poor wear resistance could further accelerate the release of these harmful ions (Wang 1996, McKellop and RoKstlund 1990, Rieu 1992).

Another problem with c.p. Ti and Ti-6Al-4V alloy is their relatively high elastic modulus. Although their elastic modulus (about 110 GPa) is much lower than the popularly-used 316L stainless steel and Co—Cr—Mo alloy (200-210 GPa), the moduli of c.p. Ti and Ti-6Al-4V alloy are still much higher than that of the natural bone (for example, only about 20 GPa or so for typical cortical bone). The large difference in modulus between natural bone and implant is the primary cause for the well-recognized "stress-shielding effect."

According to Wolff's law (bone's response to strain) and bone remodeling principles, the ability of a prosthetic restoration/implant construct to transfer appropriate stresses to the surrounding bone can help maintain integrity of the bone. There has been, and still is, a concern about the high elastic modulus of metallic implants compared to bone. Stress shielding phenomenon, more often observed in cementless hip, knee prostheses and spinal implants, can potentially lead to bone resorption and eventual failure of the arthroplasty (Sumner and Galante 1992, Engh and Bobyn 1988).

Both strain gauge analysis (Lewis et al. 1984) and finite element analysis (Koeneman et al. 1991) demonstrated that lower modulus femoral hip implant components result in stresses and strains that are closer to those of intact femur, and lower modulus hip prosthesis better simulates the natural femur in distributing stress to adjacent bone tissue (Cheal 1992, Prendergast and Taylor 1990). Canine and sheep implantation studies revealed significantly reduced bone resorption in the animals with low modulus hip implants (Bobyn et al. 1992). Bobyn et al. (1990, 1992) also showed that the bone loss commonly experienced by hip prosthesis patients may be reduced by using a prosthesis with lower modulus.

It is generally accepted that reduction in Young's modulus value of an implant may improve stress redistribution to the adjacent bone tissues, reduce stress shielding and eventually prolong device lifetime. Metallic implant materials with higher strength/modulus ratios are more favorable due to a combined effect of high strength and reduced stress-shielding risk.

It is known that reduction in Young's modulus value of an implant can reduce stress shielding and prolong device lifetime, and that a metallic implant material with a higher strength/modulus ratio is favorable due to a combined effect of high strength and reduced stress-shielding risk. Nevertheless, from the viewpoint of alloy design, simultaneously increasing the alloy strength and increasing the alloy modulus has always been a great challenge. The strength and modulus of alloys are almost always increased, or decreased, at the same time.

A series of β and near-β phase Ti alloys with better biocompatibility and lower moduli (than Ti-6Al-4V) have recently been developed. Nevertheless, these alloys usually need to contain large amounts of such β-promoting elements as Ta, Nb and W. For example, about 50 wt % and 35 wt % of Ta and Nb, respectively, are needed to form a β-phase binary Ti—Ta alloy and Ti—Nb alloy. Addition of large amounts of such heavy weight, high cost and high melting temperature elements increases the density (Low density is one inherent advantage of Ti and Ti alloys), manufacturing cost, and difficulties in processing.

More recently an Al and V-free, high strength, low modulus α" phase Ti—Mo based alloy system (typically Ti-7.5Mo) has been developed in the present inventors' laboratory, which demonstrates mechanical properties superior to most existing implantable Ti alloys and a great potential for use as orthopedic or dental implant material.

Biocompatibility of this α" type Ti-7.5Mo alloy was confirmed through cytotoxicity test and animal implantation study. The cell activity of this alloy is similar to that of $Al_2O_3$ (control). Animal study indicates that, after 6 weeks of implantation, new bone formation is readily observed at alloy surface. It is interesting to note that, after 26 weeks, the amounts of new bone growth onto the surface of Ti-7.5Mo implants at similar implantation site are dramatically larger than that of Ti-6Al-4V implant, indicating a much faster healing process.

U.S. Pat. No. 6,726,787 B2 provides the process for making such a biocompatible, low modulus, high strength titanium alloy, which comprises preparing a titanium alloy having a composition consisting essentially of at least one isomorphous beta stabilizing element selected from the group consisting of Mo, Nb, Ta and W; and the balance Ti, wherein said composition has a Mo equivalent value from about 6 to about 9. The key process for obtaining the low modulus, high strength titanium alloys is that the alloys must undergo a fast cooling process at a cooling rate greater than 10° C. per second, preferably greater than 20° C. per second from a temperature higher than 800° C. Said Mo equivalent value, [Mo]eq, is represented by the following equation, [Mo]eq=[Mo]+0.28[Nb]+0.22[Ta]+0.44[W], wherein [Mo], [Nb], [Ta] and [W] are percentages of Mo, Nb, Ta and W, respectively, based on the weight of the composition.

Nevertheless, alloys with a non-cubic (non-symmetrical) orthorhombic crystal structure α" phase are generally difficult to be cold-worked. The poor cold-workability largely limits the applications of the materials. Titanium alloys with an α" phase primarily include Ti—Mo based, Ti—Nb based, Ti—Ta based and Ti—W based alloys.

SUMMARY OF THE INVENTION

A primary objective of the present invention is to provide an article made of a titanium-molybdenum alloy with relatively higher strength and relatively lower modulus.

Another primary objective of the present invention is to provide a process for making an article made of titanium-molybdenum alloy relatively higher strength and relatively lower modulus.

In order to accomplish the aforesaid objective a process for making an article of a titanium alloy having α" phase as a major phase disclosed in the present invention comprises the following steps:

providing a work piece of a titanium-molybdenum alloy having α" phase as a major phase; and cold working at least a portion of said work piece at room temperature once or repeatedly to obtain a green body of said article, wherein the resultant cold worked portion of said green body has an average thickness which is 10%-90% of an average thickness of said at least a portion of said work piece, and the cold worked portion has α" phase as a major phase.

The present invention also provide an article of a titanium alloy having α" phase as a major phase made by the process of the present invention, wherein the resultant cold worked portion of said green body from step b) has yield strength of about 600 to 1100 MPa and a modulus of elasticity of about 60-85 GPa.

Preferably, the titanium-molybdenum alloy in step a) consists essentially of 7-9 wt % of molybdenum and the balance titanium. More preferably, the titanium-molybdenum alloy consists essentially of about 7.5 wt % of molybdenum and the balance titanium.

Preferably, said cold working in step b) is carried out once and the resultant cold worked portion of said green body has an average thickness which is 50%-90% of an average thickness of said at least a portion of said work piece.

Preferably, said cold working in step b) is carried out repeatedly and each time of said repeated cold working results in a reduction of an average thickness of the cold worked portion being less than about 40%.

Preferably, said cold worked portion resulted from step b) has α" phase as a major phase and α' phase as a minor phase.

Preferably, the cold worked portion of said green body resulted from step b) has an average thickness which is 35% to 65%, and more preferably about 50%, of an average thickness of said at least a portion of said work piece.

Preferably, the cold working in step b) comprises rolling, drawing, extrusion or forging.

Preferably, the work piece in step a) is an as-cast work piece.

Preferably, the work piece in step a) is a work piece being hot-worked, solution-treated, or a hot-worked and solution-treated work piece to a temperature of 900° C.-1200° C., followed by water quenching.

Preferably, the article is a medical implant, and the green body in step b) is a green body of the medical implant which requires further machining. Preferably, the medical implant is a bone plate, bone screw, bone fixation connection rod, intervertebral disc, femoral implant, hip implant, knee prosthesis implant, or a dental implant.

Preferably, the process of the present invention further comprises aging said green body resulted from step b), so that yield strength of said aged green body is increased by at least 10%, based on the yield strength of said green body, with elongation to failure of said aged green body being not less than about 5.0%. More preferably, said aging is carried out at 150-250° C. for a period of about 7.0 to 30 minutes.

In one of the preferred embodiments of the present invention the article made by the process of the present invention is made of a titanium-molybdenum alloy consisting essentially of about 7.5 wt % of molybdenum and the balance titanium, and the cold worked portion of said article has yield strength of about 800 to about 1100 MPa and a modulus of elasticity of about 60 to about 75 GPa.

In another one of the preferred embodiments of the present invention the article made by the process of the present invention is made of a titanium-molybdenum alloy consisting essentially of about 7.5 wt % of molybdenum and the balance titanium, and has at least a portion of the article having yield strength of about 800 to about 1100 MPa and a modulus of elasticity of about 60 to about 70 GPa.

It is surprisingly discovered by the present Inventors that, among all these α" phase Ti alloys, only Ti—Mo based α" phase alloys can be extensively cold-worked (for example, to reduce thickness by as large as 80% by cold rolling) without any difficulty. All three other α" phase Ti alloys (Ti—Nb, Ti—Ta and Ti—W alloys) are substantially unworkable at room temperature. Although the reason for this remarkable difference is not fully understood at the moment, it is for sure that the surprisingly excellent cold-workability of α" phase Ti—Mo based alloys can dramatically expand the applications of the alloys.

It is further discovered that, not only the α" phase Ti—Mo based alloy can be easily cold-worked, the mechanical strength of the alloy can be dramatically enhanced, while an excellent elongation level is maintained.

It is further discovered that, in order to obtain desirable mechanical properties of the cold-worked Ti—Mo alloy, the reduction in thickness for each single pass of the cold working should be controlled to less than about 50%, preferably less than about 40%, more preferably less than about 30%, and most preferably less than 20%.

It is further discovered that the cold-worked α" phase Ti—Mo alloy is still comprised primarily of α" phase. For example, after 65% reduction in thickness, α" phase remains close to 90%. Even after 80% reduction in thickness, α" phase is still close to 80%.

It is further discovered that, through the cold working process, while the strength of the α" phase Ti—Mo based alloy is greatly increased, the modulus of the alloy is maintained low (Note: Low modulus is one of the most important features of the α" phase Ti alloys) probably due to the dominant presence of α" phase. As mentioned earlier, the low modulus has a significant meaning in reducing stress-shielding effect as being used as a medical implant material.

To our knowledge, no one has ever claimed that a Ti—Mo alloy with an α" phase as the major phase can be extensively cold-worked with its mechanical properties being dramatically improved by the cold-working process.

DETAILED DESCRIPTION OF THE INVENTION

Figure 1:
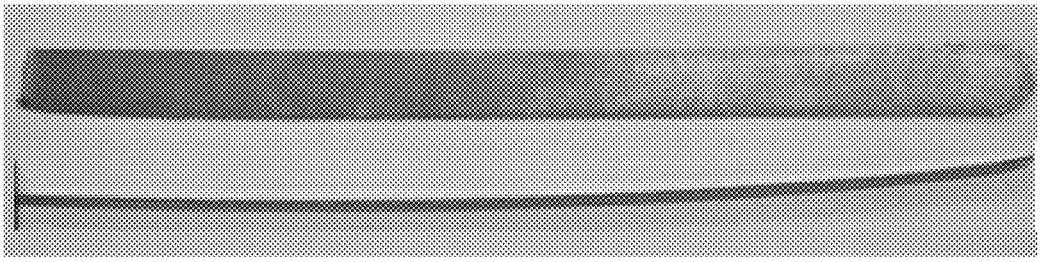
FIG. 1 is a photograph showing the superior cold-workability of an α" phase Ti-7.5Mo alloy of the present invention, wherein the thickness of the sample was largely reduced by 80% after an extensive cold rolling process.

The term "cold work" used here is a general term commonly used in the field of metal working, simply meaning the alloy is worked (by rolling, forging, extrusion, and drawing, etc.) at ambient/room temperature without specifying the exact ambient/room temperatures for the process. This term is simply as opposed to the "hot work" process, wherein a metal is heated to a high temperature to make it soft (generally from several hundreds of degrees to higher than a thousand degrees-depending on the material) (The roller or die, whereby the alloy is passed, may also be heated), followed by the metal working process conducted while the metal is still hot.

The α" phase Ti-7.5Mo alloy for cold working treatment in the present invention may be prepared by directly casting the molten alloy into a mold (a fast cooling process), by solution-treating (heating to beta-phase regime, typically 900-1000° C.) a cast alloy followed by water quenching (a fast cooling process), or by solution-treating a mechanically or thermo-mechanically worked (e.g., rolled, drawn, forged, or extruded) alloy followed by water quenching.

Experimental Methods and Results

Preparation of α" Phase Binary Ti—Mo, Ti—Nb, Ti—Ta and Ti—W Alloys:

Four different α" phase binary Ti alloys (Ti-7.5 wt % Mo, Ti-20 wt % Nb, Ti-37.5 wt % Ta and Ti-18.75 wt % W) were prepared for the study. The Ti-7.5Mo alloy was prepared from grade-2 commercially pure titanium (c.p. Ti) bars (Northwest Institute for Non-ferrous Metal Research, China) and molybdenum wire of 99.95% purity (Alfa Aesar, USA). The Ti-20Nb alloy was prepared from same c.p. Ti bars and niobium turnings of 99.8% purity (Strem Chemicals Inc., USA). The Ti-37.5Ta alloy was prepared from same c.p. Ti bars and tantalum powder of 99.9% purity (Alfa Aesar, England). The Ti-18.75W alloy was prepared from same c.p. Ti bars and tungsten powder of 99.9% purity (Acros Organics, USA).

The various Ti alloys were prepared using a commercial arc-melting vacuum-pressure type casting system (Cast-matic, Iwatani Corp., Japan). Prior to melting/casting, the melting chamber was evacuated and purged with argon. An argon pressure of 1.5 kgf/cm$^2$ was maintained during melting. Appropriate amounts of metals were melted in a U-shaped copper hearth with a tungsten electrode. The ingots were re-melted at least three times to improve chemical homogeneity of the alloys. After each melting/casting, the alloys were pickled using $HNO_3$/HF (3:1) solution to remove surface oxide.

Prior to casting, the alloy ingots were re-melted again in an open-based copper hearth in argon under a pressure of 1.5 kgf/cm$^2$. The difference in pressure between the two chambers allowed the molten alloys to instantly drop into a graphite mold at room temperature. This fast cooling process generates a cooling rate of the alloy that is sufficient to form an α" phase. Some of these as-cast alloy samples directly underwent cold working treatment to obtain a desired shape/thickness. Other cast samples, to further improve structural uniformity, were solution-treated to a beta phase regime (about 900-1000° C.), followed by fast cooling (water quenching) to transform the beta phase into α" phase again. Thus obtained α" phase alloys then underwent cold working treatment to obtain a desired shape/thickness. The XRD results confirm that the fast-cooled (water-quenched) samples have α" phase as a major phase.

X-Ray Diffraction

X-ray diffraction (XRD) for phase analysis was conducted using a Rigaku diffractometer (Rigaku D-max IIIV, Rigaku Co., Tokyo, Japan) operated at 30 kV and 20 mA with a scanning speed of 3°/min. A Ni-filtered CuKα radiation was used for the study. A silicon standard was used for the calibration of diffraction angles. The various phases were identified by matching each characteristic peak in the diffraction patterns with JCPDS files.

Tensile Testing

A servo-hydraulic type testing machine (EHF-EG, Shimadzu Co., Tokyo, Japan) was used for tensile tests. The tensile testing was performed at room temperature at a constant crosshead speed of $8.33\times10^{-6}$ m s$^{-1}$. The average ultimate tensile strength (UTS), yield strength (YS) at 0.2% offset, modulus of elasticity (Mod) and elongation to failure (Elong) were taken from five tests under each process condition.

Cold Rolling (Rolling Conducted at Room Temperature)

Cold rolling was conducted to compare cold-workability among α" phase Ti—Mo, Ti—Nb, Ti—Ta and Ti—W alloys using a two-shaft, 100 ton level rolling tester (Chun Yen Testing Machines Co., Taichung, Taiwan). After each pass, the thickness of the samples was reduced by about 5-15% from the last pass.

Comparison in Cold-Workability Among α" phase Ti—Mo, Ti—Nb, Ti—Ta and Ti—W Alloys The photograph in FIG. 1 demonstrates the superior cold-workability of α" phase Ti-7.5Mo alloy. Even after an extensive cold rolling process, whereby the thickness of the sample was largely reduced by 80%, no structural damage was observed throughout the entire surface of the sample. It was further discovered that, even after one single-pass cold rolling, wherein the thickness was severely reduced by >50%, still no structural damage was observed.

Figure 2:
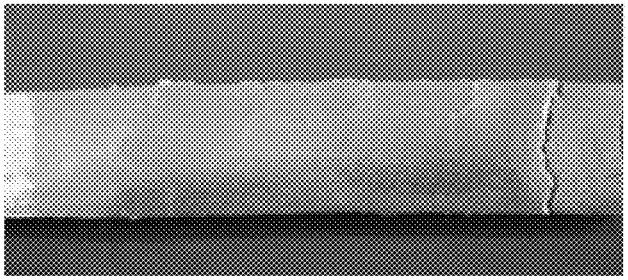
FIG. 2 is a photograph showing the poor cold-workability of an α" phase Ti-20Nb alloy, which was subjected to a cold rolling process to 30% reduction in thickness.
Figure 3:
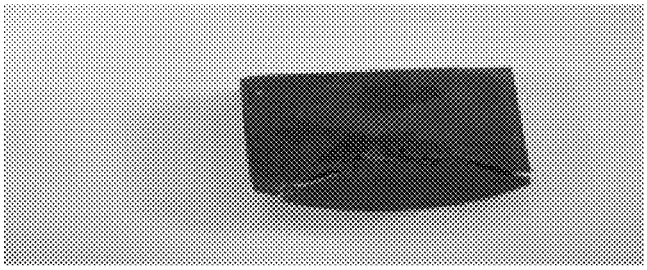
FIG. 3 is a photograph showing the poor cold-workability of an α" phase Ti-37.5Ta alloy, which was subjected to a cold rolling process to 20% reduction in thickness.
Figure 4:
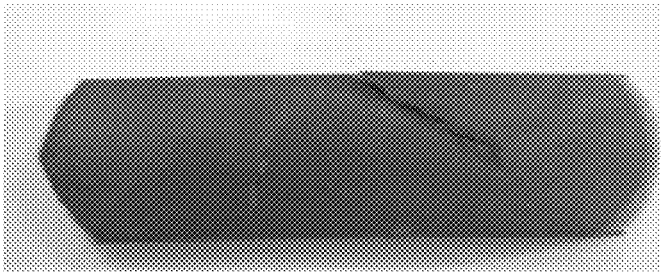
FIG. 4 is a photograph showing the poor cold-workability of an α" phase Ti-18.75W alloy, which was subjected to a cold rolling process to 20% reduction in thickness.

The photograph in FIG. 2 demonstrates the poor cold-workability of α" phase Ti-20Nb alloy. After only 30% accumulative reduction in thickness, severe structural damage was observed and the rolling process had to be aborted. The photograph in FIG. 3 demonstrates the poor cold-workability of α" phase Ti-37.5Ta alloy. After only accumulative 20% reduction in thickness, severe structural damage was observed and the rolling process had to be aborted. The photograph in FIG. 4 demonstrates the poor cold-workability of α" phase Ti-18.75W alloy. After only accumulative 20% reduction in thickness, severe structural damage was observed and the rolling process had to be aborted.

TABLE 1

Tensile properties of as-cast α" phase Ti—Mo alloys with different Mo contents

| Mo content (wt %) | YS (MPa) | UTS (MPa) | Elong (%) | Mod (GPa) | Phase (as identified by XRD) |
|---|---|---|---|---|---|
| 7.0 | 573.9 | 877.1 | 33.4 | 70.2 | α" |
| 7.5 | 540.0 | 879.1 | 29.1 | 80.2 | α" |
| 8.0 | 600.4 | 918.0 | 32.9 | 75.2 | α" |

Results:

(1) All the as-cast Ti-7.0Mo, Ti-7.5Mo and Ti-8.0Mo alloys have α" phase as the primary phase.

(2) Ti-8Mo has a little higher strength level than Ti-7.0Mo and Ti-7.5Mo.

TABLE 2

Tensile properties of cold-rolled α" phaseTi—7.5Mo alloy with different accumulative reductions in thickness (Note: All samples being cold-rolled are as-cast samples)

| Accumulative reduction in thickness (%) | YS (MPa) | UTS (MPa) | Elong (%) | Mod (GPa) |
|---|---|---|---|---|
| 0 | 540.0 | 879.1 | 29.1 | 80.2 |
| 20 | 706.8 | 1045.1 | 12.2 | 84.5 |
| 35 | 664.7 | 1098.6 | 11.3 | 77.1 |
| 50 | 855.6 | 1134.9 | 11.4 | 62.0 |
| 65 | 922.3 | 1164.0 | 9.7 | 69.1 |
| 80 | 894.1 | 1225.0 | 9.7 | 82.5 |

Results:

(1) The strength of α" phase Ti-7.5Mo alloy is greatly increased by cold-rolling.

(2) The highest strength is obtained when the thickness is reduced by 65% or 80%, while an elongation about 10% is maintained.

(3) The lowest elastic modulus is obtained when the thickness of the sample is reduced by 50%.

TABLE 3

Tensile properties of cold-rolled α" phase Ti—7.5Mo alloy with different accumulative reductions in thickness (Note: All samples being cold-rolled are solution-treated (heated at 900° C. for 5 min, followed by 0° C. water quenching) samples)

| Accumulative reduction in thickness (%) | YS (MPa) | UTS (MPa) | Elong (%) | Mod (GPa) |
|---|---|---|---|---|
| As-solution-treated | 427.1 | 845 | 31.3 | 72.3 |
| 20 | 815.4 | 1031 | 19.7 | 62.0 |
| 35 | 820.0 | 1149 | 12.6 | 71.6 |
| 50 | 903.6 | 1149 | 20.5 | 63.9 |
| 65 | 945.3 | 1129 | 17.4 | 72.3 |
| 80 | 999.6 | 1221 | 12.9 | 82.5 |

Results:

(1) The strength of α" phase Ti-7.5Mo alloy is greatly increased by cold-rolling.

(2) The highest strength (higher than that of as-solution-treated sample by 130% for YS and by 44% for UTS) is obtained when the thickness is reduced by 80%, while a sufficient elongation of about 13% is still maintained.

(3) The lowest modulus is obtained when the thickness of the sample is reduced by 50%.

TABLE 4

Tensile properties of Ti—7.5Mo alloy under different aging conditions. (All α" phase Ti—7.5Mo alloy samples for aging treatment are prepared by solution treatment, followed by cold rolling with 50% reduction in thickness. Aging was carried out in a quartz tube, which had been evacuated, followed by purging with inert (argon) gas. All aged samples were air-cooled to room temperature from the aging temperature.)

| Sample (Aging conditions, Temp/Time) | YS (MPa) | UTS (MPa) | Modulus (GPa) | Elongation (%) |
|---|---|---|---|---|
| Cold rolling 50% (no aging) | 904 | 1149 | 64 | 20.5 |
| Cold rolling 50% (200° C./15 m) | 1013 | 1193 | 66 | 14.6 |
| Cold rolling 50% (200° C./30 m) | 919 | 1213 | 67 | 5.3 |
| Cold rolling 50% (250° C./30 m) | 1006 | 1237 | 68 | 4.2 |
| Cold rolling 50% (250° C./240 m) | 1044 | 1236 | 68 | 1.8 |
| Cold rolling 50% (350° C./30 m) | 997 | 1263 | 76 | 0.7 |
| Cold rolling 50% (350° C./240 m) | 731 | 1086 | 74 | 3.1 |

Results: Aging conditions of 200° C. for 15 minutes will enhance the yield strength (YS) of the cold-rolled α" phase Ti-7.5Mo alloy by about 12% with the elongation to failure still being maintained at 14.6%. It can been from Table 4 that the aging temperature should not be increased to 350° C. and the period of time for aging is preferably no longer than 30 minutes for keeping the elongation to failure not less than 5%.

TABLE 5

Comparison in tensile properties among selected cold-rolled α" phase Ti—7.5Mo alloy and popularly used commercially pure titanium and Ti—6Al-4VELI.

| Material | YS (MPa) | UTS (MPa) | Mod (GPa) | Elong (%) | YS/Mod ($\times 10^3$) | UTS/Mod ($\times 10^3$) |
|---|---|---|---|---|---|---|
| c.p. Ti (Grade 2) | 235 | 345 | 100 | 20 | 2.35 | 3.45 |
| c.p. Ti (Grade 4) | 483 | 550 | 100 | 15 | 4.8 | 5.5 |
| Ti—6Al—4V (ELI) (ASTM F136) | 795 | 860 | 114 | 10 | 7.0 | 7.5 |
| Ti—7.5Mo Cold-rolled (50% reduction in thickness) | 903.6 | 1149.0 | 63.9 | 20.5 | 14.1 | 18.0 |
| Ti—7.5Mo Cold-rolled (65% reduction in thickness) | 945.3 | 1129.0 | 72.3 | 17.4 | 13.1 | 15.6 |
| Ti—7.5Mo Cold-rolled (80% reduction in thickness) | 999.6 | 1221.0 | 82.5 | 12.9 | 12.1 | 14.8 |

Results:

(1) The strength/modulus ratio (one important performance index for high strength, low modulus implant material) of α" phase Ti-7.5Mo alloy is dramatically increased by cold rolling.

(2) The YS/modulus ratio of 50%-cold-rolled sample is higher than that of popularly-used Ti-6Al-4V (ELI) by about 100%, than grade-4 c.p. Ti by about 190%, than grade-2 c.p. Ti by about 500%. The UTS/modulus ratio of 50%-cold-rolled sample is higher than that of popularly-used Ti-6Al-4V (ELI) by about 140%, than grade-4 c.p. Ti by about 230%, than grade-2 c.p. Ti by about 420%.

(3) The YS/modulus ratio of 65%-cold-rolled sample is higher than that of popularly-used Ti-6Al-4V (ELI) by about 90%, than grade-4 c.p. Ti by about 170%, than grade-2 c.p. Ti by about 450%. The UTS/modulus ratio of 50%-cold-rolled sample is higher than that of popularly-used Ti-6Al-4V (ELI) by about 110%, than grade-4 c.p. Ti by about 180%, than grade-2 c.p. Ti by about 350%.

(4) The YS/modulus ratio of 80%-cold-rolled sample is higher than that of popularly-used Ti-6Al-4V (ELI) by about 70%, than grade-4 c.p. Ti by about 150%, than grade-2 c.p. Ti by about 400%. The UTS/modulus ratio of 50%-cold-rolled sample is higher than that of popularly-used Ti-6Al-4V (ELI) by about 100%, than grade-4 c.p. Ti by about 170%, than grade-2 c.p. Ti by about 330%.

In the following an α" phase Ti-7.5Mo alloy was repeatedly cold rolled, wherein the reduction in thickness for each single pass was controlled to be less than 15% as shown in Table 6.

TABLE 6

A typical cold rolling (CR) process with multiple rolling passes and their induced reductions in thickness.

| Pass number | Thickness (mm) | Reduction in thickness (mm) | Reduction in thickness (%) | Accumulative reduction in thickness (mm) | Accumulative reduction in thickness (%) |
|---|---|---|---|---|---|
| 0 | 4.040 (Original) | | | | |
| 1 | 3.977 | 0.063 | 1.56 | 0.063 | 1.56 |
| 2 | 3.671 | 0.306 | 7.69 | 0.369 | 9.13 |
| 3 | 3.314 | 0.357 | 9.72 | 0.726 | 17.97 |
| 4 | 3.014 | 0.300 | 9.95 | 1.026 | 25.40 |
| 5 | 2.710 | 0.304 | 10.09 | 1.330 | 32.92 |
| 6 | 2.423 | 0.287 | 10.59 | 1.617 | 40.02 |
| 7 | 2.110 | 0.313 | 12.92 | 1.930 | 47.77 |
| 8 | 1.891 | 0.219 | 10.38 | 2.149 | 53.19 |
| 9 | 1.680 | 0.211 | 11.16 | 2.360 | 58.42 |
| 10 | 1.492 | 0.188 | 11.19 | 2.548 | 63.07 |
| 11 | 1.380 | 0.112 | 7.51 | 2.660 | 65.84 |
| 12 | 1.272 | 0.108 | 7.83 | 2.768 | 68.51 |
| 13 | 1.170 | 0.102 | 8.02 | 2.870 | 71.04 |
| 14 | 1.081 | 0.089 | 8.23 | 2.959 | 73.24 |
| 15 | 1.000 | 0.081 | 7.49 | 3.040 | 75.25 |
| 16 | 0.890 | 0.110 | 11.0 | 3.150 | 77.97 |
| 17 | 0.805 | 0.085 | 9.55 | 3.235 | 80.07 |

The weight fractions of α" phase and α' phase, as well as degrees of crystallinity of cold-rolled samples were calculated from XRD patterns using a DIFFRAC SUITE TOPAS program and Rietveld method. Results are shown in Table 7.

TABLE 7

Weight fractions of α" phase and α' phase and degrees of crystallinity

| Accumulative reduction in thickness (%) | α" phase (%) | α' phase (%) | Degree of crystallinity (%) |
|---|---|---|---|
| 0 | 99.92 | 0.08 | 100 |
| 20 | 99.37 | 0.63 | 100 |
| 35 | 99.22 | 0.78 | 92 |
| 50 | 98.56 | 1.44 | 83 |
| 65 | 88.76 | 12.24 | 72 |
| 80 | 79.32 | 20.68 | 51 |

Results:

(1) The degree of crystallinity continues to decrease with increasing accumulative reduction in thickness.

(2) The cold-rolled alloy is comprised primarily of α" phase. After 65% reduction in thickness, α" phase is close to 90%, and, even after 80% reduction in thickness, α" phase is still close to 80%.

(3) With increasing accumulative reduction in thickness, α' phase content gradually increases.

The invention claimed is:

1. A process for making an article of a titanium alloy having α" phase as a major phase comprising the following steps:

a) providing a work piece of a titanium-molybdenum alloy having α" phase as a major phase; and b) cold working at least a portion of said work piece at room temperature once or repeatedly to obtain a green body of said article, wherein the resultant cold worked portion of said green body has an average thickness which is 10%-90% of an average thickness of before cold working said at least a portion of said work piece, and the cold worked portion has α" phase as a major phase, wherein said cold working in step b) is either carried out once and the resultant cold worked portion of said green body has an average thickness which is 50%-90% of an average thickness of said at least a portion of said work piece; or said cold working in step b) is carried out repeatedly and each time of said repeated cold working results in a reduction of an average thickness of the cold worked portion being less than about 40% wherein the titanium-molybdenum alloy in step a) consists essentially of about 7.5 wt % of molybdenum and the balance titanium; and wherein said cold worked portion resulted from step b) has α" phase as a major phase and α' phase as a minor phase.

2. The process of claim 1, wherein said cold working in step b) is carried out once and the resultant cold worked portion of said green body has an average thickness which is 50%-90% of an average thickness of said at least a portion of said work piece.

3. The process of claim 1, wherein said cold working in step b) is carried out repeatedly and each time of said repeated cold working results in a reduction of an average thickness of the cold worked portion being less than about 40%.

4. The process of claim 1, wherein the cold worked portion of said green body resulted from step b) has an average thickness which is 35% to 65% of an average thickness of said at least a portion of said work piece.

5. The process of claim 4, wherein the cold worked portion of said green body resulted from step b) has an average thickness which is about 50% of an average thickness of said at least a portion of said work piece.

6. The process of claim 1, wherein the cold working in step b) comprises rolling, drawing, extrusion or forging.

7. The process of claim 1, wherein the work piece in step a) is an as-cast work piece.

8. The process of claim 1, wherein the work piece in step a) is a work piece being hot-worked, solution-treated, or a hot-worked and solution-treated work piece to a temperature of 900° C.-1200° C., followed by water quenching.

9. The process of claim 1, wherein the article is a medical implant, and the green body in step b) is a green body of the medical implant which requires further machining.

10. The process of claim 9, wherein the medical implant is a bone plate, bone screw, bone fixation connection rod, intervertebral disc, femoral implant, hip implant, knee prosthesis implant, or a dental implant.

11. The process of claim 1 further comprising aging said green body resulted from step b), so that yield strength of said aged green body is increased by at least 10%, based on the yield strength of said green body, with elongation to failure of said aged green body being not less than about 5.0%.

12. The process of claim 11 wherein said aging is carried out at 150-250° C. for a period of about 7.0 to 30 minutes.

* * * * *